United States Patent [19]

Kawakami et al.

[11] 3,956,598

[45] May 11, 1976

[54] MOVING COIL PICKUP CARTRIDGE WITH DIAPHRAGM COUPLING

[75] Inventors: Hirotake Kawakami, Tokyo; Shokichi Tatara, Yokahama, both of Japan

[73] Assignee: Sony Corporation, Tokyo, Japan

[22] Filed: Dec. 17, 1974

[21] Appl. No.: 533,663

[30] Foreign Application Priority Data

Dec. 22, 1973 Japan ..... 49-1370

[52] U.S. Cl. ..... 179/100.41 K; 179/100.41 D; 274/37

[51] Int. Cl.[2] ..... H04R 9/16

[58] Field of Search ..... 179/100.41 D, 100.41 K, 179/100.41 Z, 100.41 R; 274/37

[56] References Cited

UNITED STATES PATENTS

| | | | |
|---|---|---|---|
| 2,032,194 | 2/1936 | Wiebusch | 179/100.41 D |
| 3,142,729 | 7/1964 | Davis | 179/100.41 K |
| 3,745,263 | 7/1973 | Kawakami | 179/100.41 K |

FOREIGN PATENTS OR APPLICATIONS

| | | | |
|---|---|---|---|
| 318,380 | 9/1929 | United Kingdom | 179/100.41 D |
| 318,564 | 9/1929 | United Kingdom | 179/100.41 D |

*Primary Examiner*—Raymond F. Cardillo, Jr.
*Attorney, Agent, or Firm*—Lewis H. Eslinger; Alvin Sinderbrand

[57] ABSTRACT

A pickup cartridge having a cantilever, a stylus attached to one end thereof, a permanent magnet, a plate and a pole piece made of magnetic material and coupled to the magnet forming a magnetic circuit, a magnetic gap formed between the plate and pole piece, a diaphragm fixed to the plate, a coil attached to one surface of the diaphragm and disposed in the magnetic gap, and an arm contacting with the other surface of the diaphragm and moving together with the cantilever, in which the coil is displaced in the magnetic gap through the arm and diaphragm in response to displacement of the cantilever to induce a voltage.

4 Claims, 4 Drawing Figures

MOVING COIL PICKUP CARTRIDGE WITH DIAPHRAGM COUPLING

BACKGROUND OF THE INVENTION

1. Field of the Invention

This invention relates generally to a pickup cartridge, and more particularly to a novel pickup cartridge of the moving coil type.

2. Description of the Prior Art

In a conventional moving coil type pickup cartridge, a moving coil is wound on a substantially square armature or on a cruciform armature having four projections. In detail, the armature is of a substantially square shape with one of its diagonals being disposed vertically. A cantilever arraying a stylus on its foremost end is fixed at its rear end to the center of the armature. A first coil for the right channel signal and a second coil for the left channel signal are wound on the armature. The armature is disposed in a magnetic field which is established by a permanent magnet and a yoke. In such a conventional pickup cartridge, it may be apparent that the afore-mentioned armature has a large mass due to its shape. Accordingly, an equivalent compliance of the stylus tip is small. Further, a large area of the armature necessitates a large cross sectional area of the gap between the yokes in the magnetic circuit. In addition, the magnetic reluctance of the magnetic circuit passing through the yoke is made greater due to an aperture formed in the yoke for the cantilever which extends therethrough, so that the magnetic flux density in the gap can not be made great. Further, due to the fact that the cantilever is formed in the armature, it often is difficult and expensive to replace the cantilever with a new one.

Another conventional pickup cartridge of the moving coil type consists of separate coils for the left and right channels and separate magnetic circuits for the respective coils. The magnetic circuits are formed of a permanent magnet and a yoke. The coils are wound in the gap formed in the yoke. The pickup cartridge of this type is relatively small in mass, but since the entireties of the coils are not disposed in the gap, the output signal is small and the magnetic reluctance of the magnetic circuit is not low.

SUMMARY OF THE INVENTION

According to this invention, there is provided a pickup cartridge in which the entirety of a moving coil is disposed in a DC magnetic field in a direction perpendicular to the magnetic field and a movable plate to which the moving coil is attached is displaced in response to a displacement of the stylus.

Accordingly, it is an object of the invention to provide a pickup cartridge in which the entirety of the coil is disposed in a direct magnetic field to increase a voltage induced across the coil and to positively convert the movement of the stylus into an electric signal even if the movement of the stylus is small.

It is another object of the invention to provide a pickup cartridge for stereophonic reproduction in which an arm to which a sound groove signal is transmitted through a stylus, is restricted to a rotary movement only when no signal is present and hence left and right signals are not transmitted therethrough with the result that the operation of the arm is made clear for a recorded signal and the separation characteristic for the left and right stereophonic signals can be improved.

It is a further object of the invention to provide a pickup cartridge which is clearly divided into a transmission system and a conversion system and in which a moving arm belonging to the transmission system is arranged such that the arm contacts a movable plate belonging to the conversion system, whereby a stylus can be easily replaced with a new one.

It is a still further object of the invention to provide a pickup cartridge in which a transmission system and a conversion system are divided so that the conversion system of large mass is not connected to a vibration system for picking up a sound groove signal and hence the equivalent mass of the vibration system or transmission system remains small so as to convert the sound groove signal into an electric signal with high fidelity.

DESCRIPTION OF THE PREFERRED EMBODIMENT

Figure 1:
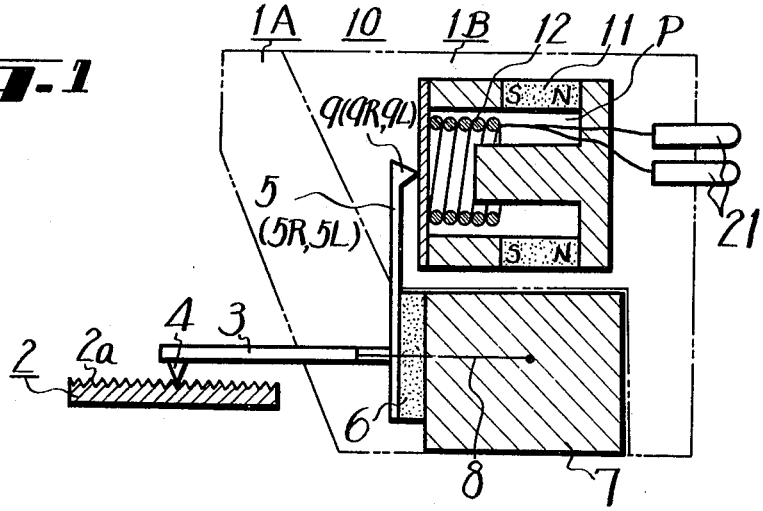
FIG. 1 is a schematic cross-sectional view for showing an embodiment of the pickup cartridge according to the invention.

As shown in FIG. 1, a pickup cartridge 10 according to this invention is formed of a transmission system 1A which will transmit a sound groove signal (mechanical vibration signal) obtained by scanning a sound groove 2*a* on a record disc 2 and a conversion system 1B which will convert the sound groove signal into a corresponding electric signal.

Figure 2:
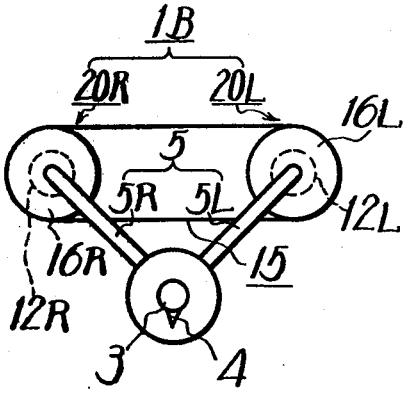
FIG. 2 is a front view for showing the pickup cartridge of the invention used for stereophonic reproduction.

The transmission system includes a cantilever 3 which may be an aluminum tube or may be constructed of a material made of carbon fibers as is well known. A stylus 4 made of diamond, sapphire or the like is attached to the tip end of the cantilever 3. An arm 5 consisting of a pair of arms 5L and 5R (FIG. 2) is attached to the other end of the cantilever 3 in such a manner that the arms 5L and 5R are arranged at the left and right sides of the vertical line passing through the stylus 4 with an angular distance of 45°, as shown in FIG. 2, and perpendicular to the cantilever 3, as shown in FIG. 1. The arm 5 has an urging projection 9 at its remote, or free, end, the urging projections 9L and 9R of the respective arms 5L and 5R extend rearwards, respectively. The illustrated pickup cartridge 10 is readily adapted for reproducing the so-called 45—45 type stereophonic signal. The end of the cantilever 3 to which the arm 5 is attached is fixed through a damper 6 made of butyl rubber or the like to a fixed part 7. A suspension wire 8 is stretched between the cantilever 3 and the fixed part 7.

The stereophonic sound groove signal picked up by the stylus 4 is transmitted to the arms 5L and 5R and then converted into a corresponding electric signal by the conversion system 1B which will be explained below.

As shown in FIG. 1, the conversion system 1B is comprised of a permanent magnet 11 capable of producing a direct magnetic field H. A moving coil 12 is disposed in a gap P and is arranged in the direct magnetic field H in its entirety. When the moving coil 12 is moved by the arms 5L and 5R in a direction perpendicular to the direct magnetic field H, as will be described, the electric signal corresponding to the sound groove signal can be derived from the moving coil 12.

The practical construction of the conversion system 1B will be now described with reference to FIG. 3. In the case of stereophonic reproduction, the conversion system 1B is, of course, formed of two conversion members which are same in construction, so that only the conversion member for the right channel signal (R signal) will be described. However, the following description is equally applicable to the conversion member for the left channel signal (L signal).

Figure 3:
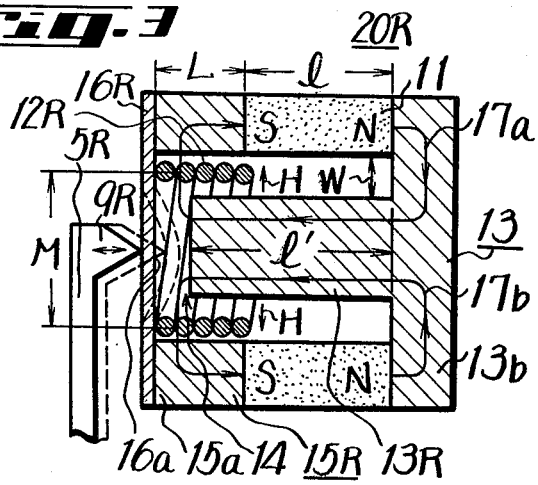
FIG. 3 is an enlarged cross-sectional view of the main part of the pickup cartridge shown in FIG. 1.

In FIG. 3, reference symbol 20R generally indicates the conversion member for the R signal. In this embodiment, the permanent magnet 11 is made to exhibit a large maximum energy product but small permeance. By way of example, a samarium-cobalt magnet is employed as the magnet 11. The magnet 11 is formed to be a cylinder with a predetermined length *l*. An N-pole yoke 13 having a rod-shaped projection 13R extending from a base 13*b* (and hence displaying a T-shaped cross-section) is attached to the N-pole side of the cylindrical magnet 11 such that the projection 13R is located within the cylindrical magnet 11 and on the axis thereof. As shown, the base 13*b* of the yoke 13 contacts with the N-pole of the magnet 11 to form the gap P with a predetermined width W between the outer surface of the projection 13R and the inner surface of the cylindrical magnet 11, or between the inner diameter of the cylindrical magnet 11 and the outer diameter of the rod-shaped projection 13R. In this case, the length *l'* of the projection 13R is selected longer than the length *l* of the magnet 11.

An S-pole yoke 15 or 15R is attached to the S-pole side of the magnet 11. In detail, the S-pole yoke 15R is made to be a cylinder coaxial with, and substantially of equal diameter to, the cylindrical magnet 11. A diaphragm 16R made of elastic material with a predetermined strength such as butyl rubber or the like is fixed to the yoke 15R at its end 15a remote from the end attached to the magnet 11. The coil 12R with a predetermined number of turn is disposed in the gap P to contact with or to be fixed to the inner surface 16A of the diaphragm, i.e., the surface exposed to the gap P. The coil 12R is formed of a fine wire (with a diameter of about 20 microns) made of a material with low density such as, for example, with aluminum which is wound, for exammple, 5 turns. In this case, the diameter M of the coil 12R is smaller than the inner diameter of the cylindrical magnet 11 but greater than the outer diameter of the rodshaped projection 13R, so that the coil 12R can move in the gap P without contacting the magnet 11 or projection 13R.

The relative arrangement between the conversion system 1B and the transmission system 1A is such that the urging projection 9R of the arm 5R contacts the outer surface of the diaphragm 16R substantially at its center. The magnetic flux originating from the magnet 11 passes through magnetic circuits from the magnet 11 through the yoke 13 and projection 13R, across the gap P, through the yoke 15R to the magnet 11, as indicated by the paths 17*a* and 17*b* in FIG. 3, to establish the direct magnetic field H in the gap P. As a result, if the coil 12R attached to the diaphragm 16R is located in the gap P as mentioned above, the entirety of the coil 12R is placed in the direct magnetic field H. In this case, the axis of the coil 12R intersects the magnetic field H at right angles. It is appreciated that the conversion member 20L for the L signal (see FIG. 2) is constructed similarly.

When the conversion members 20R and 20L are used as the conversion system 1B for stereophonic reproduction, it is preferred that the conversion members 20R and 20L are formed integrally instead of being formed separately.

Figure 4:
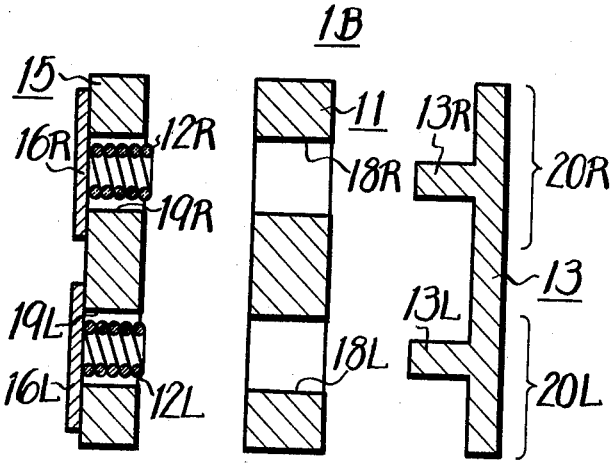
FIG. 4 is an exploded cross-sectional view of the elements forming a magnetic circuit.

FIG. 4 is an exploded cross-sectional view of the conversion system 1B for use in stereophonic reproduction. In this case, the magnet 11 is formed to be rectangular in shape with apertures 18R and 18L are disposed near the opposite edges of the magnet 11 along its longitudinal direction to form the gap P (not shown in FIG. 4). A pair of projections 13R and 13L are integrally formed on the N-pole yoke 13 at positions aligned with the apertures 18R and 18L, respectively. Apertures 19R and 19L are formed on the S-pole yoke 15 similarly aligned with the apertures 18R and 18L, respectively. The diaphragms 16R and 16L, having attached thereto the coils 12R, and 12L are attached to the yoke 15 to locate the coils 12R and 12L in the apertures 19R and 19L, respectively. Thus, the conversion system 1B can be constructed with a common magnet structure and common yokes structures.

A description will be now given on the operation of the pickup cartridge 10 of the invention. In the interest of brevity, only the operation for picking up the R signal recorded on the record disc will be described with reference to FIG. 3. The sound groove signal corresponding to the R signal picked up by the stylus 4 is transmitted through the cantilever 3 to the arm 5R for the R signal. The arm 5R is displaced in the left and right directions in FIG. 3 in response to the sound groove signal. If it is assumed that the diaphragm 16R normally is displaced by the arm 5R as shown by the dotted line in FIG. 3 when no sound groove signal is present, the diaphragm 16R may be displaced in the left and right directions from the dotted line state in response to the displacement of the stylus 4. The magnitude and velocity of the diaphragm displacement is directly related to that of the stylus 4 and cantilever 3. In this case, the displacement of the diaphragm 16R is transmitted to correspondingly move of the coil 12R. Since the entirety of the coil 12R is disposed in the direct magnetic field H and the coil axis intersects the magnetic field H at right angles, as described previously, the displacement of the stylus 4 is converted into such movement of the coil 12R that the coil moves in the left and right directions at right angles to the magnetic field H at the velocity v. As a result, a voltage which is determined by magnetic flux density B, the velocity v and the total length L of the coil 12R is induced in the coil 12R. If output terminals 21 are led out from the coil 12R, an output signal corresponding to the sound groove signal for the R signal can be obtained.

When the sound groove signal is only one for the R signal, the displacement of the stylus 4 is not transmitted to the other arm 5L (refer to FIG. 2) to cause displacement in the left and right directions, but the stylus displacement is transmitted to the arm 5L only to rotate it about the axis thereof. Accordingly, in such a case the arm 5L can not displace the coil 12L in the conversion member 20L with the result that no voltage is induced in the coil 12L.

The above description is given only the preferred embodiment of the invention, but it will be apparent that many modifications and variations could be effected by one skilled in the art without departing from the spirit or scope of the novel concepts of the invention.

We claim as our invention:

1. A pickup cartridge comprising signal conversion means and replaceable signal transmission means, the signal transmission means including a cantilever having a stylus at one end thereof adapted to scan the sound grooves of a record disc and to produce mechanical vibrations corresponding to sound groove signals; and an arm mechanically coupled at one end thereof to said cantilever at a position remote from said stylus, said arm being bidirectionally displaced in direct relation to said mechanical vibrations of said cantilever; and the signal conversion means including a first magnetic yoke having an end plate and a projection therefrom so as to be of substantially T-shaped cross-section; permanent magnet means having spaced apart north and south poles, one of said poles being in contact with said end plate, said permanent magnet means and said projection defining a gap; a second magnetic yoke having one end thereof in contact with the other of said poles of said permanent magnet means, thereby forming a magnetic circuit for direct magnetic flux originating from said permanent magnet means, said circuit comprising said one pole of said permanent magnet means, said end plate of said first magnetic yoke, said projection of said first magnetic yoke, said gap, said second magnetic yoke and said other pole of said permanent magnet means; a diaphragm coupled to the other end of said second magnetic yoke and having a surface thereof in contact with the other end of said arm such that said diaphragm is displaced in response to the bidirectional displacement of said arm; and a coil coupled to the other surface of said diaphragm, the entirety of said coil being disposed in the magnetic field and having its longitudinal axis substantially perpendicular to said magnetic flux in said gap, whereby a voltage is induced in said coil in response to the movement thereof caused by the displacement of said diaphragm.

2. A pickup cartridge in accordance with claim 1 wherein said permanent magnet means is cylindrical, said projection from said end plate of said first magnetic yoke being located within said cylindrical permanent magnet means and on the axis thereof; and said second magnetic yoke is cylindrical coaxial with said permanent magnet means and having a substantially equal inner diameter.

3. A pickup cartridge in accordance with claim 1 further comprising second signal transmission means including a second arm mechanically coupled at one end thereof to said cantilever at a position remote from said stylus, said second arm being angularly spaced from said first arm by 90°; and second signal conversion means including said first magnetic yoke having a second projection from said end plate substantially parallel to said first projection such that a second gap is formed between said second projection and said permanent magnet means; said first magnetic yoke, said permanent magnet means and said second magnetic yoke forming a second magnetic circuit for direct magnetic flux originating from said permanent magnet means, said second circuit comprising said one pole of said permanent magnet means, said end plate of said first magnetic yoke, said second projection of said first magnetic yoke, said second gap, said second magnetic yoke and said other pole of said permanent magnet means; a second diaphragm coupled to the other end of said second magnetic yoke and spaced from the first diaphragm, said second diaphragm having a surface thereof in contact with the other end of said second arm such that said second diaphragm is displaced in response to the bidirectional displacement of said second arm; and a second coil coupled to the other surface of said second diaphragm, the entirety of said second coil being disposed in the magnetic field and having its longitudinal axis substantially perpendicular to said magnetic flux in said second gap.

4. A pickup cartridge in accordance with claim 3 wherein said permanent magnet means includes two apertures aligned with said first and second projections, respectively, so as to receive said projections therein, said projections being longer than the length of said respective apertures; and said second magnetic yoke includes two apertures coaxial with and of substantially the same diameter as said permanent magnet apertures so that a portion of said respective projections extends thereinto.

* * * * *